US005394820A

United States Patent [19]

Dach

[11] Patent Number: 5,394,820

[45] Date of Patent: Mar. 7, 1995

[54] MOTORIZED WATER VEHICLE

[76] Inventor: Samuel Dach, 22 Havatzelet Hasharon, 44802 Kfar Saba, Israel

[21] Appl. No.: 158,541

[22] Filed: Nov. 29, 1993

[51] Int. Cl.[6] ..... B63B 35/73

[52] U.S. Cl. ..... 114/270

[58] Field of Search ..... 114/315, 270; 440/84, 440/87, 2

[56] References Cited

U.S. PATENT DOCUMENTS 3,119,364 1/1964 Brown ..... 440/84 X
3,158,882 12/1964 Kibby ..... 114/270 X
3,164,016 1/1965 Dinsmore ..... 440/2 X
3,270,707 9/1966 Rozanski ..... 440/87
3,324,819 6/1967 Tetyak ..... 440/87
3,371,646 3/1968 Mela ..... 114/270
3,763,817 10/1973 Francis ..... 114/270

*Primary Examiner*—Sherman Basinger
*Attorney, Agent, or Firm*—Benjamin J. Barish

[57] ABSTRACT

A motorized water vehicle includes a buoyant unit formed with a throughgoing opening at an intermediate location, and a separate power unit mounted within the opening when the two units are assembled together. The power unit includes an internal combustion engine to be enclosed by the buoyant unit when the two units are in assembled condition in the water, and a propelling device to project through the bottom of the buoyant unit into the water.

18 Claims, 3 Drawing Sheets

FIG. 1
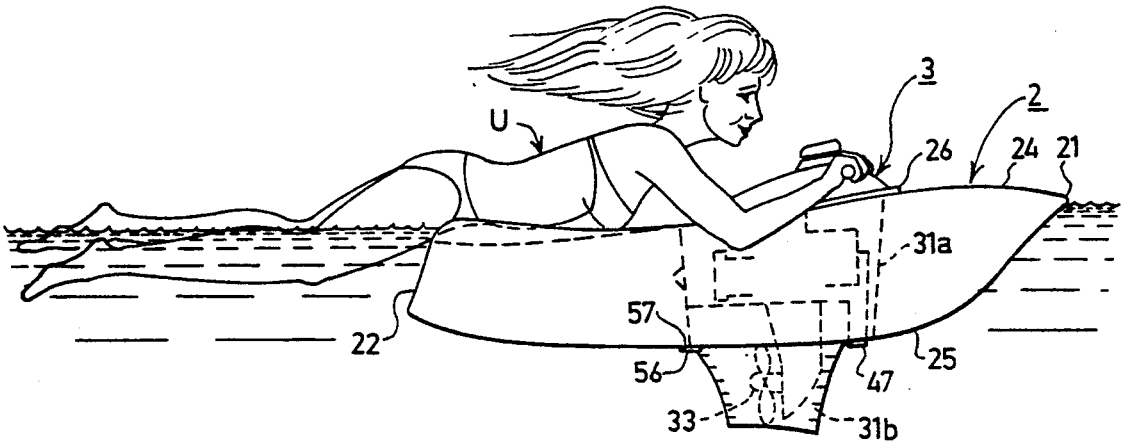
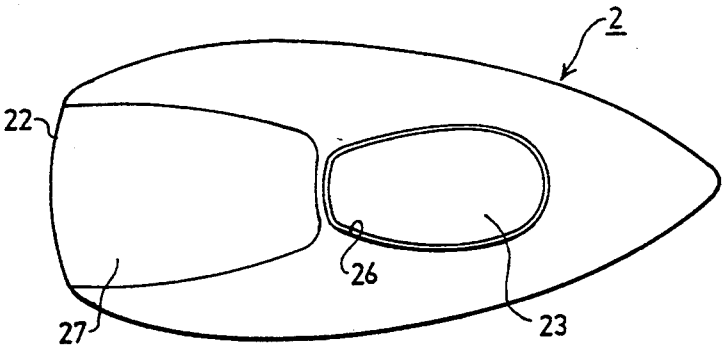
FIG. 2

MOTORIZED WATER VEHICLE

FIELD AND BACKGROUND OF THE INVENTION

The present invention relates to a motorized water vehicle, and particularly to such a vehicle for use for recreational purposes.

Various types of motorized water vehicles for recreational purposes are known, but as a rule they are relatively heavy and/or bulky, and therefore relatively difficult to traansport to the water site where they are to be used, and/or difficult to handle at the water site.

OBJECT AND BRIEF SUMMARY OF THE INVENTION

An object of the present invention is to provide a motorized water vehicle which is constructed such as to make it relatively simple to transport to the water site where it is to be used, and also simple to handle at the water site.

According to one aspect of the present invention, there is provided a motorized water vehicle comprising: a buoyant unit formed with an opening extending therethrough at an intermediate location of the buoyant unit; and a separate power unit mounted within the opening when the two units are assembled together; the power unit including a power drive to be enclosed by the buoyant unit, a propelling device to project through the bottom of the buoyant unit into the water when the two units are in assembled condition in the water and a pair of handlebars fixed to and projecting outwardly from the opposite sides of the power unit and graspable by the user for steering the vehicle the rear portion of the buoyant unit rearwardly of the opening being of a length to receive only the upper portion of a user's body when in a reclining position.

By thus providing the water vehicle with two separable parts, the water vehicle is easily transportable from one location to another. For example, in the embodiment described below, the buoyant unit weighs about seven kilograms, and the power unit weighs about fifteen kilograms, such that the two units, when separated, can be easily transported by a single person.

According to further features in the described preferred embodiment, the power unit includes a handle at its upper end to facilitate carrying and handling the power unit when separated from the buoyant unit. In addition, one of the handlebars includes a drive control member for controlling the speed of the vehicle. Such a construction, as will be described more particularly below, enables the vehicle to be easily handled in the water.

According to another aspect of the present invention, there is provided a motorized water vehicle, comprising: a buoyant unit formed with a throughgoing opening at an intermediate location thereof; and a separate power unit mounted within the opening when the two units are assembled together. The upper surface of the buoyant unit is formed at its rear end with a recess for receiving the abdominal portion of a user such that the buoyant unit supports the upper portion of the user's body as well as the power unit. The power unit includes an internal combustion engine to be enclosed by the buoyant unit when the two units are in assembled condition in the water, and a propelling device to project through the bottom of the buoyant unit into the water. The internal combustion engine is located so as to be below the water level when the two units are in assembled condition in the water, and includes an air inlet at its upper end, and an exhaust duct at its lower end to be submerged in the water for directing the exhaust gases into the water. The propelling device is a rotatable impeller enclosed within an impeller housing having protective screens on its front and rear ends.

Further features and advantages of the invention will be apparent from the description below.

BRIEF DESCRIPTION OF THE DRAWINGS

The invention is herein described, by way of example only, with reference to the accompanying drawings, wherein:

FIG. 1 pictorially illustrates one form of two-unit motorized water vehicle constructed in accordance with the present invention;

FIG. 2 is a top plan view only of the buoyant unit in the vehicle of FIG. 1;

DESCRIPTION OF A PREFERRED EMBODIMENT

Figure 3:
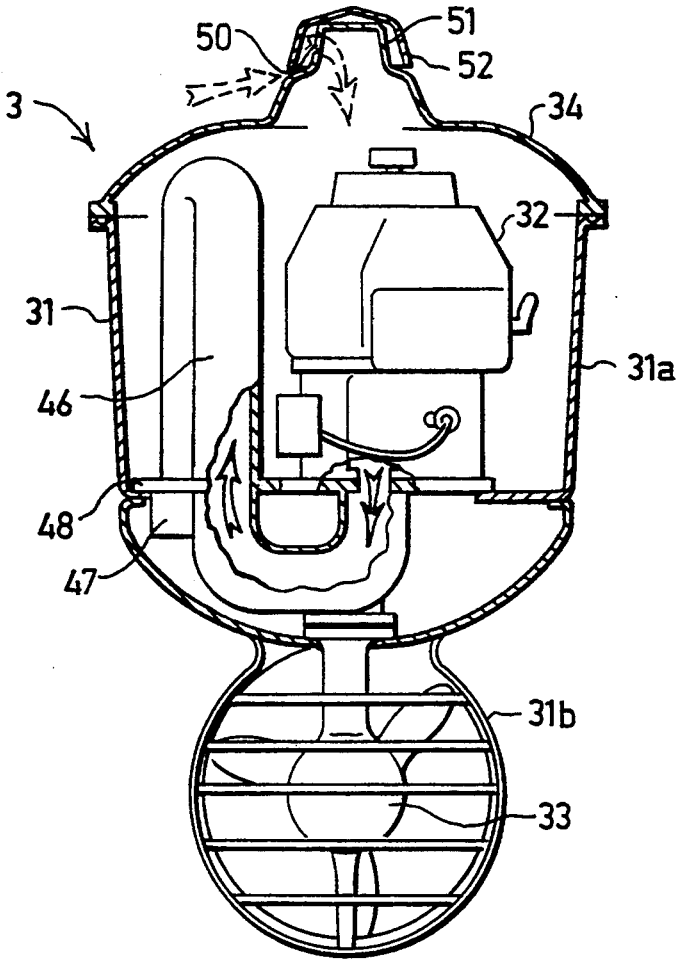
FIGS. 3 and 4 are front and top views, respectively, only of the power unit of the vehicle of FIG. 1.

The motorized water vehicle illustrated in the drawings comprises two basic units, namely a buoyant unit, generally designated 2, and a separate power unit, generally designated 3. Both units are so constructed as to permit the power unit 3 to be easily and quickly mounted to the buoyant unit 2, thereby permitting the two units to be separately carried to the water site for assembly there.

The buoyant unit 2 is made of suitable buoyant material, such as expanded plastic, so as to buoyantly support in the water not only itself, but also the power unit 3, and the user U as shown in FIG. 1. The buoyant unit is hydrodynamically shaped, being narrow at its front end 21 and relatively wide at its rear end 22. It is formed with a throughgoing opening 23 at an intermediate location, which opening extends through its upper surface 24 and its lower surface 25. Opening 23 is lined with a sealing strip 26, to provide a seal between the buoyant unit 2 and the power unit 3 when received within opening 23.

Buoyant unit 2 is further formed with a recess 27 starting slightly rearwardly of opening 23 and extending to its rear end 22. Recess 27 is intended to receive the abdominal portion of the user or passenger U, such that the buoyant unit supports the upper portion of the user's body as shown in FIG. 1.

Figure 4:
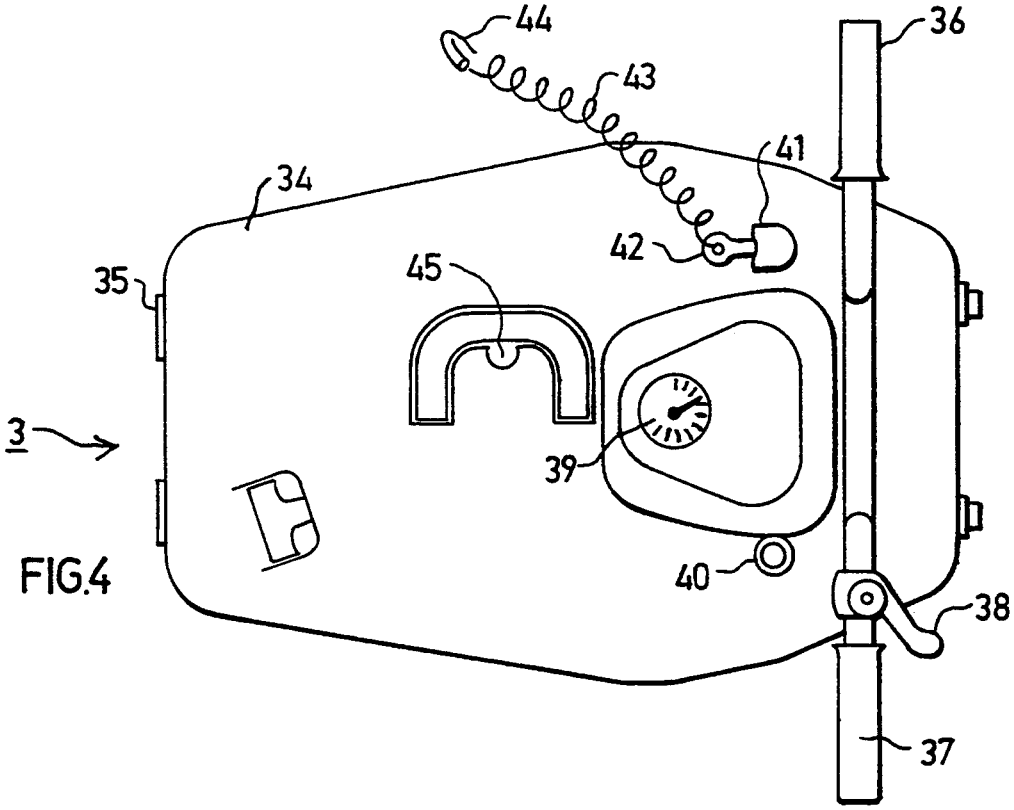
Figure 5:
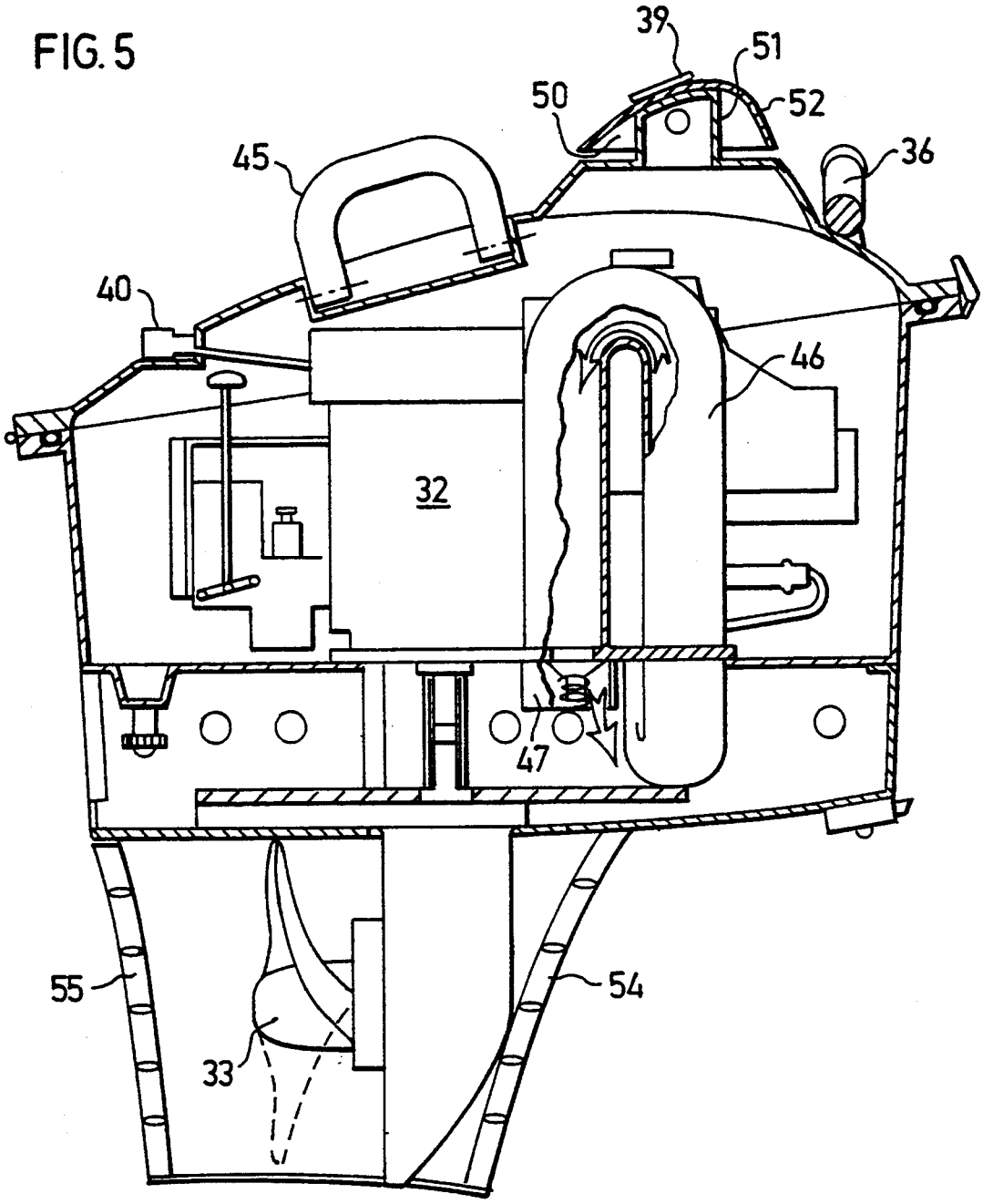
FIG. 5 is a side view of the power unit of the vehicle of FIG. 1.

The power unit 3 is more particularly illustrated in FIGS. 3–5. It includes a housing 31 having an upper section 31*a* housing an internal combustion engine 32 serving as the power drive, and a lower section 31*b* housing an impeller 33 serving as the propelling device for propelling the vehicle. The shape of the upper housing section 31*a* corresponds to the shape of opening 23 in the buoyant unit 24, such that the power unit 3 may be easily inserted into the opening 23 and snugly fits within that opening. When so inserted into opening 23 of the buoyant unit 2, the internal combustion engine 32 within housing section 31*a* is enclosed by the buoyant unit, whereas housing section 31*b* housing the impeller 33 projects through the bottom of the buoyant unit into the water for propelling the vehicle, as shown in FIG. 1.

The upper housing section 31*a* housing the internal combustion engine 32 includes a cover 34 hingedly mounted at one end, as shown at 35 in FIG. 4, to permit opening the cover in order to provide access into the interior of the housing. The cover 34 carries on its outer face a pair of handlebars 36, 37, projecting outwardly of the power unit so as to graspable by the user for steering the vehicle. One of the handlebars, namely handlebar 37, is provided with a drive control member 38, in the form of a lever engageable by a finger of the use's hand, for controlling the flow of fuel to the internal combustion engine 32, and thereby the speed of the vehicle.

Cover 34 further includes a speedometer 39 for measuring the speed of the vehicle, and an on/off switch 40 for turning on or off the internal combustion engine 32 of the vehicle. Cover 34 further includes a safety switch 41 receiving a key 42 attached at one end of a flexible cord 43. The opposite end of cord 43 carries a buckle 44 attachable to the body of the user, such that if the user is thrown from the buoyant unit, or otherwise leaves the buoyant unit 2, key 42 acts as an actuator to automatically shut-off the internal combustion engine 32. Finally, cover 34 includes a handle 45 to facilitate carrying and handling the power unit 3.

The internal combustion engine 32 within housing section 31*a* may be of any conventional construction. It includes an exhaust conduit 46 (FIGS. 3 and 5) leading to an exhaust pipe 47 which is normally submerged in the water during the operation of the vehicle, as shown in FIG. 1, so that the exhaust gases are discharged directly into the water at the front part of the buoyant body 2, remote from the user. Exhaust pipe 47 includes a one-way valve 48 (FIG. 3) to prevent entry of the water into the housing.

Air is supplied to the internal combustion engine via an air inlet 50 (FIG. 3) formed in an upper section 51 of the cover and shielded by a cap 52. The speedometer 39 is mounted on the upper surface of cap 52.

The lower section 31*b* of the power unit housing 31, which houses the impeller 33, is provided with a screen or protective grill 54 at its front side, and with a similar screen or protective grill 55 at its rear side.

The power unit 3 is secured within opening 23 in any suitable manner, as by the provision of locking bolts 56 securable within openings 57 (FIG. 1) formed in the buoyant unit 2.

The manner of using the motorized water vehicle illustrated in the drawings will be apparent from the above description. Thus, the power unit 3 may be easily separated from the buoyant unit 2 and carried to the water site by means of its handle 45. Both units may be constructed of relatively light weight so that both units can be carried by a single person, using one arm to grasp the buoyant unit, and the hand of the other arm to grasp the power unit via its handle 45. For example, in one construction, the buoyant unit 2 weighs seven kilograms, and the power unit 3 weights fifteen kilograms.

At the water site, the two units may be quickly assembled by passing the power unit 3 through opening 23 in the buoyant unit 2, and securing the two units together by locking bolts 56. The vehicle may then be used in the manner illustrated in FIG. 1, wherein the buoyant unit 2 supports the upper part of the user's body, and the handlebars 36, 37, grasped by the user, permit the user to steer the vehicle, as it is propelled through the water by the impeller 33 driven by the internal combustion engine 32. Speed control lever 38 on handlebar 37 permits the user to conveniently control the speed of the vehicle. Should the user be thrown off the vehicle, the cutoff switch 41 will automatically be actuated to cut off the engine 33 since the key 42, attached to the user by flexible cord 43 and buckle 44, will be automatically withdrawn from the cutoff switch 41.

While the invention has been described with respect to one preferred embodiment, it will be appreciated that this is set forth merely for purposes of example, and that many other variations, modifications and applications of the invention may be made.

What is claimed is:

1. A motorized water vehicle, comprising:

a buoyant unit formed with an opening extending therethrough at an intermediate location of the buoyant unit; and a separate power unit mounted within said opening when the two units are assembled together;

said power unit including a power drive to be enclosed by the buoyant unit, a propelling device to project through the bottom of the buoyant unit into the water when the two units are in assembled condition in the water, and a pair of handlebars fixed to and protecting outwardly from the opposite sides of the power unit so as to be graspable by the user for steering the vehicle;

the rear portion of the buoyant unit rearwardly of said opening being of a length to receive only the upper portion of a user's body when in a reclining position.

2. The vehicle according to claim 1, wherein said rear portion of the buoyant unit is formed with a longitudinally-extending recess for receiving the upper portion of the user's body.

3. The vehicle according to claim 1, wherein said power unit includes a handle to facilitate carrying the power unit when separated from the buoyant unit.

4. The vehicle according to claim 1, wherein one of said handlebars includes a drive control member for controlling the speed of the vehicle.

5. The vehicle according to claim 1, wherein said power drive is an internal combustion engine.

6. The vehicle according to claim 5, wherein said internal combustion engine includes an exhaust duct to be submerged in the water for directing the exhaust gases into the water.

7. The vehicle according to claim 5, wherein the internal combustion engine is below the water level when the two units are in an assembled condition in the water.

8. The vehicle according to claim 5, Wherein said power unit includes an air inlet at its upper end.

9. The vehicle according to claim 1, wherein said propelling device is a rotatable impeller.

10. The vehicle according to claim 9, wherein said impeller is enclosed within an impeller housing having protective screens on its front and rear ends.

11. The vehicle according to claim 1, wherein said power unit includes locking bolts received within openings formed in the buoyant unit for locking the power unit to the buoyant unit.

12. The vehicle according to claim 1, wherein said power unit includes a speedometer for measuring the speed of the vehicle.

13. The vehicle according to claim 1, wherein said power unit includes a safety switch actuated by an actuator attachable to the user to automatically shut off the power drive of the power unit in the event the user is separated from the buoyant unit.

14. A motorized water vehicle, comprising: a buoyant unit formed with a throughgoing opening at an intermediate location thereof;

and a separate power unit mounted within said opening when the two units are assembled together;

the upper surface of said buoyant unit being formed at its rear end with a recess for receiving the abdominal portion of a user such that the buoyant unit supports the upper portion of the user's body as well as the power unit;

said power unit including an internal combustion engine to be enclosed by the buoyant unit when the two units are in assembled condition in the water, and a propelling device to project through the bottom of the buoyant unit into the water;

said internal combustion engine being located so as to be below the water level when the two units are in assembled condition in the water, and including an air inlet at its upper end, and an exhaust duct at its lower end to be submerged in the water for directing the exhaust gases into the water;

said propelling device being a rotatable impeller enclosed within an impeller housing having protective screens on its front and rear ends.

15. The vehicle according to claim 14, wherein the power unit includes handlebars projecting outwardly from the sides of the power unit and graspable by the user for steering the vehicle.

16. The vehicle according to claim 15, wherein one of said handlebars includes a speed control member for controlling the speed of the vehicle.

17. The vehicle according to claim 14, wherein the power unit includes a handle at the upper end thereof to facilitate carrying and handling the power unit as a separate unit.

18. The vehicle according to claim 14, wherein said power unit further includes a safety switch actuated by an actuator attachable to the user to automatically shut off the internal combustion engine in the event the user is separated from the buoyant unit.

* * * * *